US005561506A

United States Patent [19]

Kasahara

[11] Patent Number: 5,561,506

[45] Date of Patent: Oct. 1, 1996

[54] DEVELOPING DEVICE FOR AN IMAGE FORMING APPARATUS HAVING A DEVELOPER NORMALIZING MECHANISM INDEPENDENT OF A DEVELOPING MECHANISM

[75] Inventor: Nobuo Kasahara, Yokohama, Japan

[73] Assignee: Ricoh Company, Ltd., Tokyo, Japan

[21] Appl. No.: 390,219

[22] Filed: Feb. 16, 1995

[30] Foreign Application Priority Data

Feb. 16, 1994 [JP] Japan ..... 6-019309

[51] Int. Cl.[6] ..... G03G 13/08

[52] U.S. Cl. ..... 355/246; 222/DIG. 1

[58] Field of Search ..... 355/246, 245, 355/260; 222/DIG. 1

[56] References Cited

U.S. PATENT DOCUMENTS 4,142,655 3/1979 Fantuzzo ..... 222/DIG. 1
4,743,936 5/1988 Bares ..... 222/DIG. 1
4,926,217 5/1990 Bares ..... 355/253
5,305,064 4/1994 Trott et al. ..... 355/260

FOREIGN PATENT DOCUMENTS 3-174238 7/1991 Japan .
4-198966 7/1992 Japan .

*Primary Examiner*—R. L. Moses
*Attorney, Agent, or Firm*—Oblon, Spivak, McClelland, Maier & Neustadt, P.C.

[57] ABSTRACT

A developing device for developing a latent image electrostatically formed on an image carrier is disclosed. The device has a developing mechanism for depositing a toner and carrier mixture, i.e., developer on the image carrier, a developer normalizing mechanism for normalizing the developer and located at a different position from the developing mechanism, and a developer transferring and circulating mechanism for transferring the developer to the developing mechanism and developer normalizing mechanism. The device is easy to maintain since the developing mechanism is small in size and simple in configuration.

12 Claims, 7 Drawing Sheets

DEVELOPING DEVICE FOR AN IMAGE FORMING APPARATUS HAVING A DEVELOPER NORMALIZING MECHANISM INDEPENDENT OF A DEVELOPING MECHANISM

BACKGROUND OF THE INVENTION

The present invention relates to a developing device for use in an electrophotographic image forming apparatus, particularly a printer, facsimile apparatus or copier of the type using a toner and carrier mixture or bicomponent developer.

A developing device for the above application has developing means facing an image carrier on which a latent image is to be electrostatically formed. The developing means deposits a toner and carrier mixture on the image carrier to develop the latent image formed thereon. Various kinds of arrangements have heretofore been proposed in relation to the developing device, as follows:

(1) An arrangement wherein means for agitating a toner and carrier mixture or developer disposed in a photoconductive drum and communicated to a developing unit by a piping so as to circulate the developer (Japanese Patent Publication No. 5-21082);

(2) An arrangement for supplying a developer or carrier to the casing of a developing device, discharging the developer from the casing in the same amount as the developer or carrier fed, and replenishing toner in an amount matching toner consumed by development and determined by volume sensing means (Japanese Patent Publication No. 60-18065);

(3) An arrangement for detecting the density of a developer in terms of a change in volume (Japanese Patent Laid-Open Publication No. 50-19459);

(4) An arrangement consisting of developing section, means for supplying a preselected amount of carrier to the developing section on the elapse of a predetermined developing time or on the production of a predetermined number of copies, detecting means for detecting a change in the toner and carrier mixture ratio and generating a signal representing it, means for replenishing toner to the developing section in response to the signal, and means for discharging more than a predetermined amount of developer from the developing section (Japanese Patent Laid-Open Publication No. 51-13249);

(5) An arrangement for extending the life of a developer by replenishing the developer existing in a developing device with an additional toner and carrier mixture (Japanese Patent Laid-Open Publication No. 4-353881).

However, the conventional developing device with any of the above configurations has the following problems. A developing sleeve faces a photoconductive element or image carrier. The device has an accumulating portion in which the developer accumulates, and a hopper for replenishing fresh toner. The accumulating portion and hopper are located in the vicinity of the developing sleeve in order to supply the developer to the sleeve. Further, the accumulating portion and hopper are constructed integrally with the developing means which is implemented as a unit accommodating the sleeve. Such a configuration is bulky, complicates the construction of the entire developing device, and thereby obstructs maintenance.

SUMMARY OF THE INVENTION

It is, therefore, an object of the present invention to provide a developing device for an image forming apparatus which has a simple and miniature construction and, therefore, facilitates maintenance.

In accordance with the present invention, a developing device for developing a latent image electrostatically formed on an image carrier has developing means for depositing a developer consisting of toner and carrier on the image carrier, developer normalizing means for normalizing the developer and located at a different position from the developing means, and developer transferring and circulating means for transferring the developer to the developing means and developer normalizing means. Also, in accordance with the present invention, a developing device for developing a latent image electrostatically formed on an image carrier has developing means for depositing a developer consisting of toner and carrier on the image carrier, developer storing means for storing the developer and located at a different position from the developing means, and developer transferring and circulating means for transferring the developer to the developing means and developer storing means.

BRIEF DESCRIPTION OF THE DRAWINGS

The above and other objects, features and advantages of the present invention will become apparent from the following detailed description taken with the accompanying drawings in which.

DESCRIPTION OF THE PREFERRED EMBODIMENT

Figure 1:
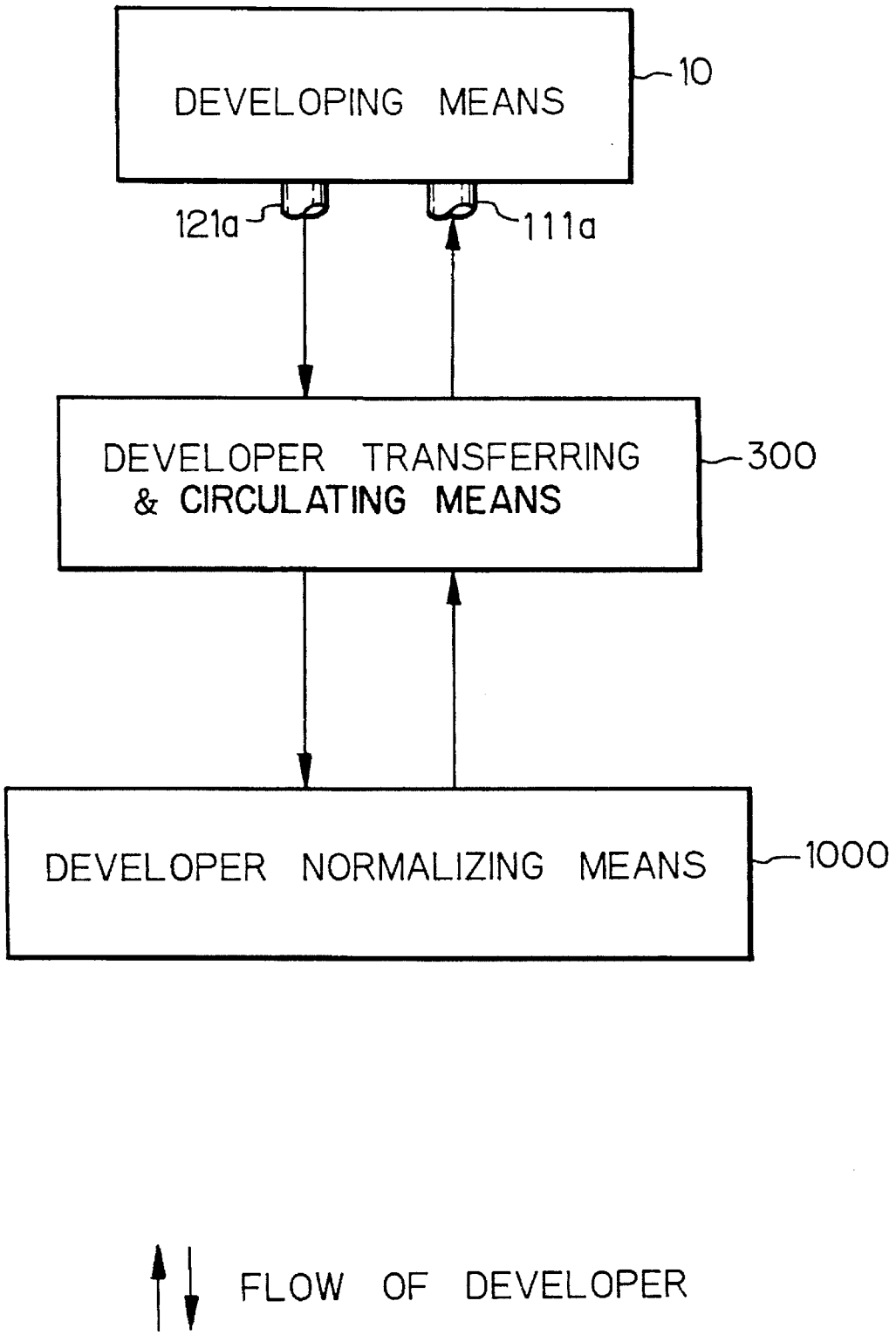
FIG. 1 is a block diagram schematically showing the general construction of a developing device embodying the present invention.

Referring to FIG. 1 of the drawings, a developing device embodying the present invention is shown and generally made up of developing means 10, developer transferring and circulating means 300, and developer normalizing means 1000. The developer normalizing means 1000 is implemented as a unit independent of the developing means 10 and located at a different position from the latter. A developer is circulated between the developer normalizing means 100 and the developing means 10 by the developer transferring and circulating means 300.

The developing means 10 has an inlet 111*a* for receiving a developer normalized by the normalizing means 1000, and an outlet 121*a* for returning excess part of the developer to the normalizing means 1000. The developing means 10 uses a dry bicomponent type developer, i.e., a toner and carrier mixture and effects magnet brush development, although it may effect cascade development. To normalize a developer means to control the toner and carrier mixture ratio and to normalize the density of the developer as well as the charge to deposit thereon. The developing means 10 and developer normalizing means 1000, which are each located at a different position, are connected to each other by the developer transferring and circulating means 300. A toner supply member may be mounted on the developer normalizing means 1000. The developer transferring and circulating means 300 has a supply passage communicating the normalizing means 1000 to the inlet 111*a* (indicated by upward arrows), and a collection passage extending from the outlet 121*a* to the normalizing means 1000 (indicated by downward arrows). In addition, the transferring and circulating means 300 has a pump for conveyance and impurity removing means at suitable positions in the circulation path formed by the means 10, 1000, and passages mentioned above.

The developer flowing through the supply passage has the density and charge thereof adequately controlled by the developer normalizing means 1000. On the other hand, the developer flowing through the collection passage is an excess developer joined in development and having not controlled in density or charge yet. The supply passage and collection passage are implemented by tubings while the pump for conveyance is implemented by a pump for transferring powder, as will be described later. The pump may be built in the developer normalizing means 1000, if desired.

With the above configuration, it is possible to locate the developer normalizing means 1000, having toner supply means, at a position different from the position of the developing means 10. This not only simplifies the construction of the developing means 10 to a considerable degree but also reduces the size of the developing means 10. As a result, an image forming apparatus having such a developing device is simple in construction, provided with a sufficient margin in respect of layout, and therefore easy to maintain. Moreover, the developer normalizing means 1000 maintains the developer in an optimal condition at all times and thereby insures high quality and stable images.

The developing device will be described specifically with reference to FIG. 2. As shown, an image carrier 1 is implemented as a photoconductive drum although it may be implemented as a photoconductive belt, if desired. A latent image is formed on the drum 1 by a conventional electrophotographic procedure including charging and exposing steps. The developing means supplies the developer, or toner and carrier mixture, to the drum 1 so as to develop the latent image.

The developing means 10, of course, includes a developing sleeve 100 from which the developer is supplied to the drum 1. In the illustrative embodiment, the developing means 10 refers to a unit including, in addition to the sleeve 100, a developer supply member 110, a developer collecting member 120, a developer regulating member 130, passage means, and a casing 150 accommodating such members. The sleeve 100 has a conventional structure made up of a sleeve and magnets disposed therein. The developing means 10 is located at a developing position adjoining the drum 1. The developing position intervenes between an exposure position where imagewise light P is incident to the drum 1 to form a latent image and an image transfer position where a transfer charger Q is located for transferring a toner image derived from the latent image to a transfer medium. At the developing position, the sleeve 100 faces the drum 1 and moves in the same direction as the drum 1.

Figure 2:
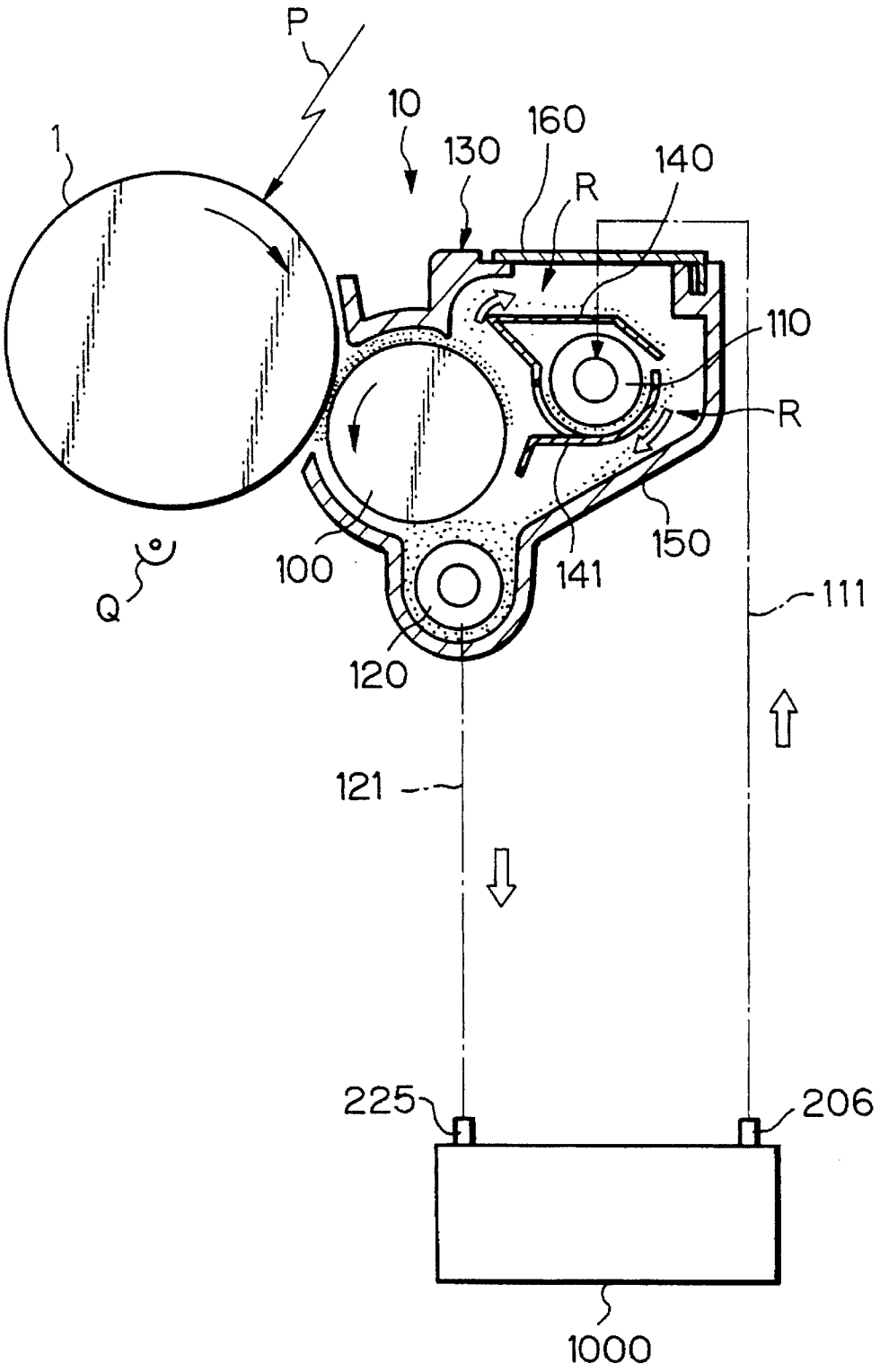
FIG. 2 shows the embodiment specifically and shows developing means thereof in a section.

The drum 1 has an axis extending perpendicularly to the sheet surface of FIG. 2. Let the axial direction of the drum 1 be referred to as a widthwise direction hereinafter. Since an image is formed on the drum 1 in the widthwise direction, the sleeve 100 must supply the developer to the drum 1 in the widthwise direction. For this reason, the sleeve 100 has a width matching the width of the drum 1. The developer supply member 110, therefore, covers at least substantially the entire widthwise dimension of the sleeve 100 in order to supply the developer to the sleeve 100. The developer collecting member 120 drives the excess developer to the outside of the developing means 10 and, like the developer supply member 110, covers the entire widthwise direction of the sleeve 100.

As shown in FIG. 2, the developer supply member 110 and developer collecting member 120 are respectively located at a two o'clock position and a five o'clock position around the sleeve 100. The supply member 110 and collecting member 120, or conveying means in the form of screws, are driven by drive means, not shown, for conveying the developer toward the inlet 111*a* and outlet 121*a*, respectively. The collecting member 120 is disposed below the supply member 110 in order to collect excess part of the developer transferred from the supply member 110 to the sleeve 100 and falling due to gravity.

Figure 3:
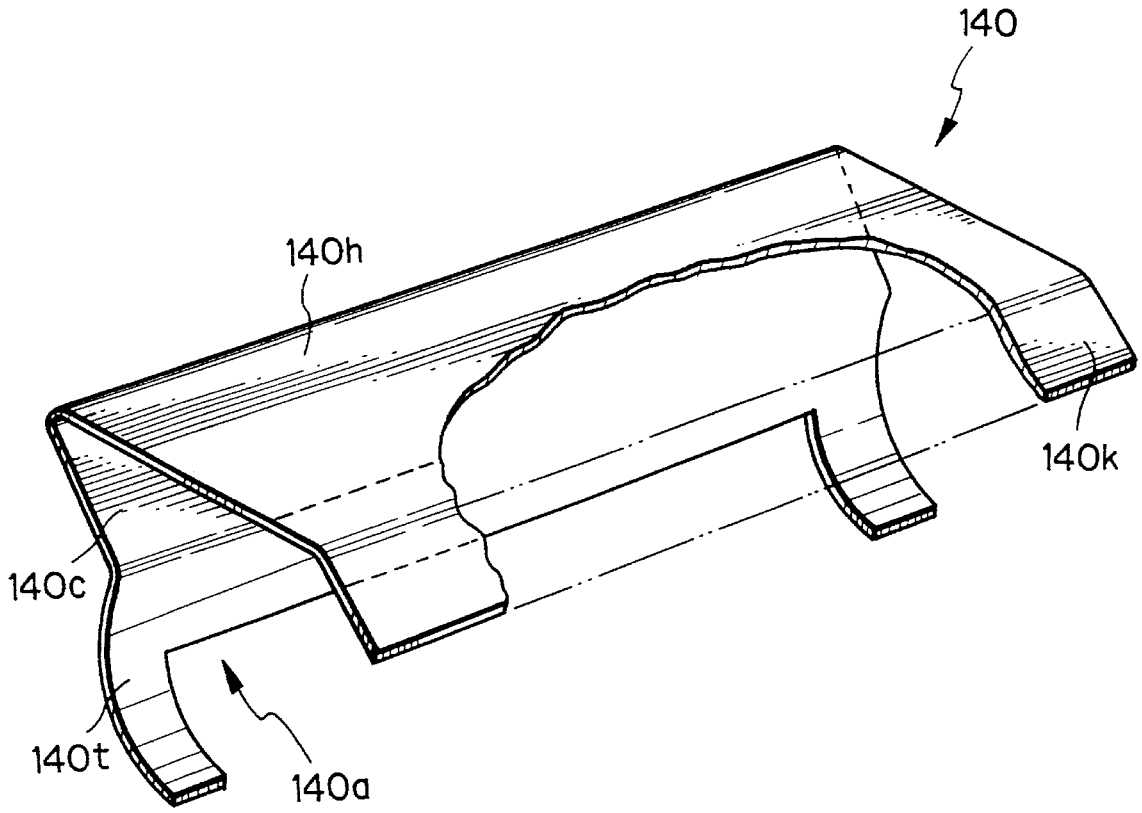
FIG. 3 is a perspective view showing a specific configuration of a developer guide included in the embodiment.

To execute the conveying function effectively, the developer collecting member 120 is received in a generally U-shaped bottom portion of the casing 150. A developer guide 140 and a covering 141 cover the developer supply member 110 and play the role of passage means for guiding the developer scraped off by the developer regulating member 130 to the collecting member 120. As shown in FIG. 3, the developer guide 140 has a horizontal portion 140*h* overlying the supply member 110, a bent portion 140*c* extending from the horizontal portion 140*h*, a round portion 140*t* contiguous with the bent portion 140*c*, and a slant potion 140k also extending from the horizontal 140*h*. The covering 141 includes an openable lid 160 which forms part of the casing 150, FIG. 2. A preselected space is defined between the various portions of the developer guide 140 and those of the casing 150 and constitutes a passage R. The excess developer is caused to flow to the collecting member 120 along the passage R. The round portion 140t is formed with a notch 140*a* over a dimension corresponding to the width of the sleeve 100. The developer is supplied from the supply member 110 to the sleeve 100 via the notch 140*a*.

The developer regulating member, or so-called doctor, 130 is positioned between the sleeve 100 and the developer supply member 110 and affixed to the casing 150 at one end thereof. The free end of the doctor 130 adjoins the periphery of the sleeve 100. The doctor 130 levels the developer on the sleeve 100 by scraping it off and, at the same time, collects the removed developer. The supply member 110 is interposed between the doctor 130 and the collecting member 120. When the developer deposited on the sleeve 100 is moved in a direction indicated by an arrow in FIG. 2, excess part the developer is removed by the doctor 130 and brought to the collecting member 120 via the passage R.

Figure 4:
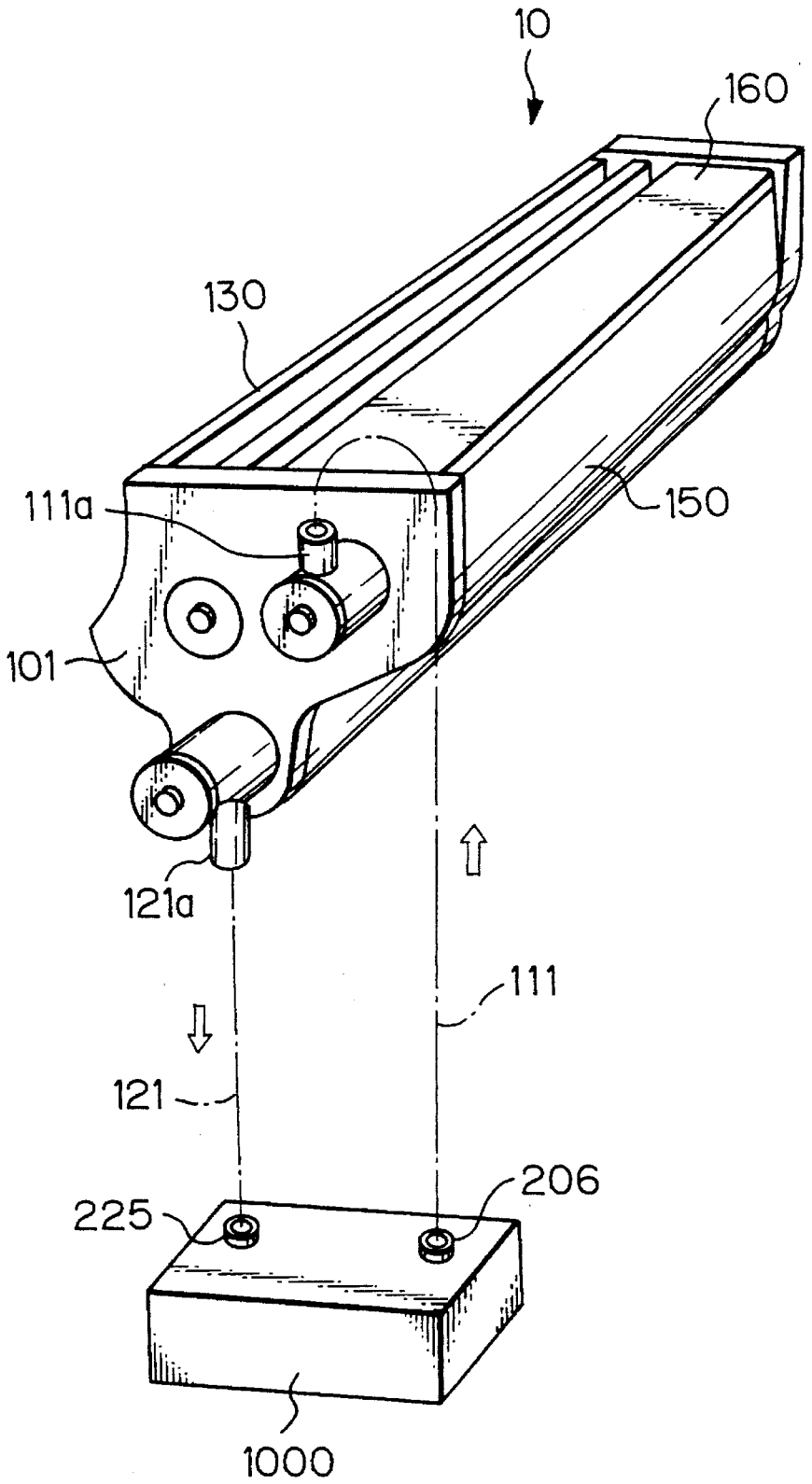
FIG. 4 shows the developing means in a side elevation.
Figure 5:
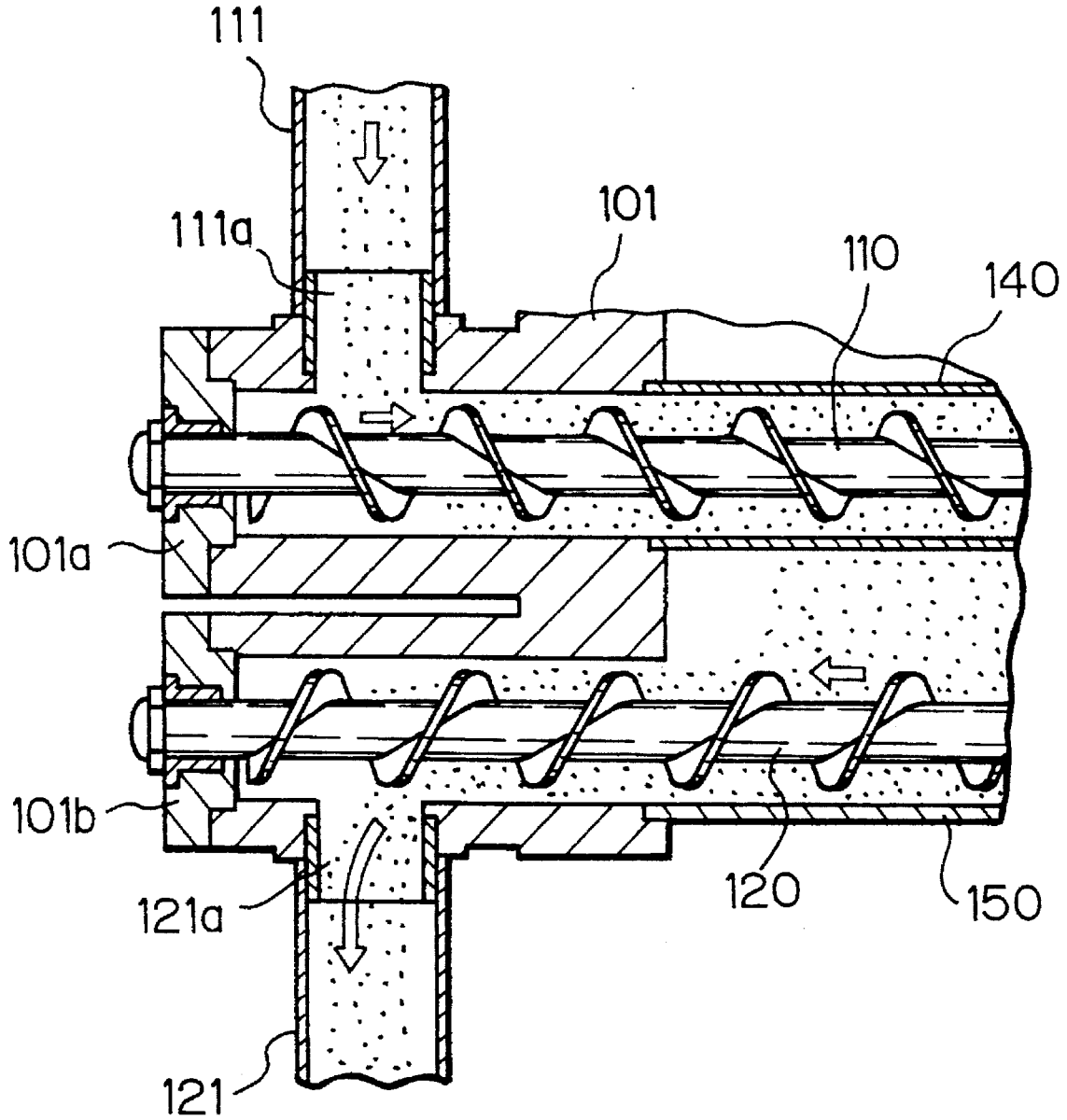
FIG. 5 is a section showing one end of the developing means.

As shown in FIGS. 4 and 5, the casing 150 has opposite widthwise ends thereof enclosed by side plates. One side plate 101 is partly protruded in a hollow cylindrical configuration to form circular bores for the screw portions of the developer supply member 110 and collecting member 120. Lids 101*a* and 101*b* close the circular bores of the side plate 101 and rotatably support the shafts of the screw portions of the members 110 and 120, respectively. The previously stated inlet 111*a* and outlet 121*a* are respectively positioned at the intermediate portions of the bores and extend perpendicularly to the bores. As shown in FIGS. 1, 2, and 4 the developer normalizing means 1000 has an inlet 225 and an outlet 206. The inlet 111*a* and outlet 121*a* of the casing 150 are respectively communicated to the outlet 206 and inlet 225 of the normalizing means 1000 by a supply tube 111 and a collection tube 121.

In operation, the developer is fed from the developer normalizing means 1000 to the developing means 10 by the supply tube 111. In the developing means 10, the developer is conveyed in the axial direction of the sleeve 100 by the developer supply member 110 and deposited on the entire surface of the sleeve 100 via the notch 140*a*, FIG. 3. Then, the developer is conveyed toward the developing position while being leveled by the doctor 130. Part of the toner removed by the doctor, i.e., excess toner is guided to the developer collecting member 120 along the passage R between the upper portion of the developer guide 140 and the casing 150. At the same time, part of the developer supplied to the drum 1, but not deposited on the latent image, i.e., another excess developer is also guided to the collecting member 120. The excess developer is conveyed by the collecting member 120 to the developer normalizing means 1000 via the outlet 121*a* and collection tube 121.

In the above configuration, the developing means 10 should only have the sleeve 100, supply member 110 and collecting member 120 driven. This further promotes the simple and miniature construction of the developing means and, in addition, reduces power consumption.

Figure 6:
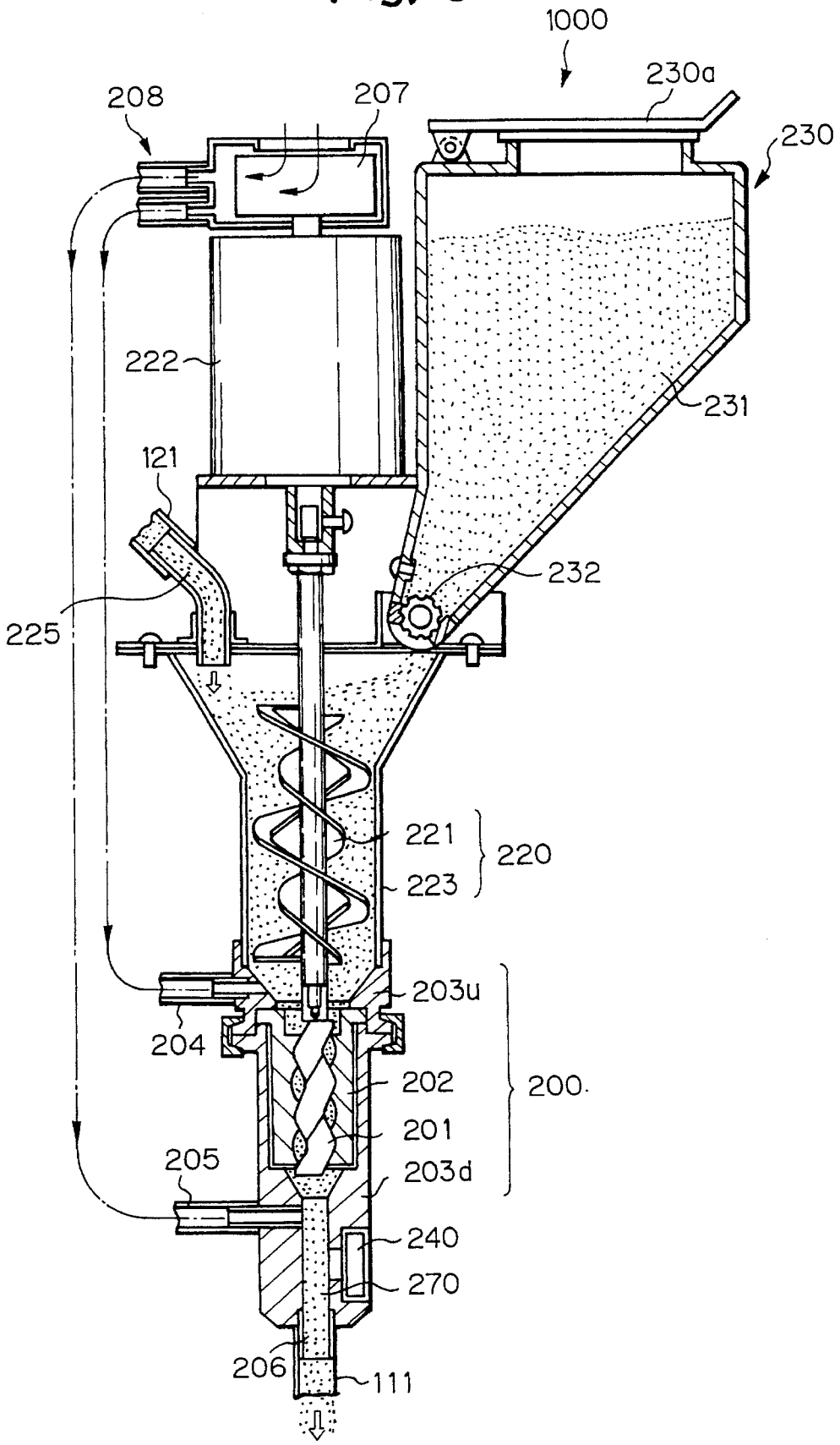
FIG. 6 shows developer normalizing means and developer transferring and circulating means included in the embodiment.

The developer normalizing means 1000 and developer transferring and circulating means 300 will be described specifically. As shown in FIG. 6, the developer driven out of the developing means 10 is returned to the normalizing means 1000 by the collection tube 121. The normalizing means 1000 includes a toner replenishing unit, or toner replenishing means, 230 for normalizing the developer density, i.e., the mixture ratio of toner and carrier, constituting the developer. An agitating unit 220 and a drive motor 222 constitute developer agitating means for depositing an adequate amount of charge on the toner and carrier. Density sensing means 240 senses the density of the developer. Impurity removing means, not shown, removes paper dust and other impurities from the developer being circulated.

The agitating unit 220 has a receptacle 223 having a flared top and a cylindrical bottom, and a screw 221 received in the receptacle 223 and rotated by the motor 222. The outlet of the toner replenishing unit 230 and the inlet 225 are open into the flared top of the receptacle 223. The toner replenishing unit 230 has a lid 230*a* which may be opened to replenish fresh toner 231 into the unit 230. The replenishing unit 230 has an outlet at the bottom thereof and has it closed by the toner supply member 232. The toner supply member 232 includes a cylindrical rotatable portion having a number of axially extending notches on the periphery thereof. The member 232 in rotation supplies the toner received in the notches into the receptacle 223. The member 232 is connected to a conventional developer density control circuit, not shown, and controlled thereby.

The outlet 206 is formed at the bottom of the developer normalizing means 1000. A passageway 270 adjoins the outlet 206. The density sensing means, or sensor, 240 is connected to the developer density control circuit and located in the passageway 270, i.e., a lower pump holder 203*d* which will be described. The sensor 240 senses the toner concentration of the developer flowing through the passageway 270 and sends the output thereof to the developer density control circuit. In response, the control circuit processes the sensor output, rotates the toner supply member 232 in accordance with the sensor output, and thereby replenishes an adequate amount of toner from the replenishing unit 230 into the receptacle 223.

As stated above, the controlled amount of fresh toner 231 from the toner replenishing unit 230 is added to the developer collected from the developing means 10. As a result, an adequate toner and carrier (developer) mixture ratio (developer density) is set up in the receptacle 223. In addition, an amount of charge optimal for development is deposited on the developer in the agitating unit 220.

The developer normalized by the above procedure is fed to a powder pump unit 200 located below the agitating unit 220. The powder pump unit 200 is implemented by a conventional screw pump and constitutes the developer transferring and circulating means 300 in cooperation with the tubes 121 and 111. The pump unit 200 is made up of a rotor 201 connected to the drive motor 222 via the agitating screw 221, a stator 202 made of rubber or similar elastic material and surrounding the rotor 201, and an upper pump holder 203*u* and a lower pump holder 203*d* holding the stator 202 in cooperation. The upper pump holder 203*u* connects the pump unit 200 to the agitating unit 220. The previously mentioned passageway 270 extends throughout the lower pump holder 203*d* and communicates the outlet of the pump unit 200 to the outlet 206. A lower air inlet 205 is communicated to the passageway 270 in the vicinity of the outlet of the screw pump, i.e., the lower end of the rotor 201.

An upper air inlet 204 is communicated to the receptacle 223 in the vicinity of the inlet of the pump unit 200. A fan 207 is accommodated in a fan case and rotated by the drive motor 222. Two discharge ports 208 are formed through part of the fan case. The other ends of the upper and lower air inlets 204 and 205 are respectively communicated to the discharge ports 208 by tubes. When the drive motor 222 is rotated, the fan 207 sucks air from the outside and blows into the developer via the upper and lower air inlets 204 and 205 at a rate of about 0.52 liters per minute. The air promotes the fluidization of the developer and thereby allows it to be surely conveyed by the screw pump 200. Such a small amount of air, contributed to the conveyance of the developer, flows out via gaps existing in the developing means 10. While the fan 207 is shown as being coaxially mounted on the motor 222, an independent pump may be used to feed air to the upper and lower air inlets 204 and 205.

The developer passed through the pump unit 200 is discharged from the outlet 206 while having the density thereof sensed by the sensing means 240. The developer from the outlet 206 is delivered to the developing means 10 by the supply tube 111.

In the illustrative embodiment, the developer normalizing means 1000 is located below the developing means 10. Hence, the developer is transferred from the developing means 10 to the normalizing means 1000 by gravity without the need for pumping means, although the delivery from the normalizing means 1000 to the developing means 10 needs it. When the positional relation between the developing means 10 and the normalizing means 1000 by reversed or when they are positioned at the same level, a pump will be suitably arranged in the circulation path for conveying the developer.

To enhance image quality, the impurity removing means capable of removing paper dust and other impurities from the developer should preferably be disposed in either the collection tube 121 or the supply tube 111. The impurity removing means may be implemented as a filter, electrostatic adhesion, centrifugal separation or the like.

The screw pump of the pump unit 200 is a rotary volume type monoaxial eccentric screw pump; the rotor or male screw 201 is received in the stator 202 having a hollow cylindrical configuration. The rotor 201 is rotated by the drive motor 222 at the center of an eccentric shaft. Hence, the rotor 201, like a piston, moves in a reciprocating motion while rotating within the stator 202. At this instant, since the powdery developer fills up the space between the rotor 201 and the stator 202 and is continuously transferred under the supply of an extremely small amount of air, it continuously flows through the supply tube 111 while filling it up. This insures high quantitativeness and accurate control over the flow rate during the course of continuous transfer. Further, air should only be supplied in a small amount implementing the fluidization of the powder and the uniform flow over the entire transfer line. Moreover, the low-speed high-density transfer of the developer prevents the powder from being crushed, needs only a small-diameter conduit, frees the conduit from wear, obviates noise, and simplifies the structure. Hence, the pump unit 200 is cost-effective, reliable, and easy to maintain.

When the carrier of the developer is deteriorated due to aging, the entire developing unit should be exhausted of the developer. In such a case, the end of the collection tube 121 connected to the developer normalizing means 1000 is removed from the means 1000 and then connected to a suitable container. In this condition, the drive motor 222 energized to collect the developer, containing the deteriorated carrier, in the container from all the units of the developing device. The developer collected in the container may be simply discarded or suitably recycled.

The collection of the waste developer stated above may also be effected just before maintenance, e.g., replacement of the various members of the developing device. This will facilitate maintenance since the developer is removed from the constituent members beforehand. Such a procedure is far more efficient than the conventional procedure which requires a serviceman to remove the entire developing device from the machine body, disassemble the developing device, and then collected the developer by manual operation.

The amount of developer which can be accommodated in the developer normalizing means 1000 is determined by the volume of the receptacle 223. Therefore, the volume of the receptacle 223 may be increased to increase the interval between the consecutive replacement of the deteriorated developer.

The developer normalizing means 1000 is implemented as a unit independent of the developing means 10 and connected to the latter only by the supply tube 111 and collection tube 121. This kind of configuration eliminates limitations on the location for installation, guarantees an economical capacity for accommodating the developer, promotes easy developer replacement, and enhances productivity including assembly and adjustment. The free layout of the normalizing means 1000 allows even the toner replenishing unit 230 to be located at a desired position convenient for a person to replenish fresh toner.

The easy replenishment of toner will be further promoted if use is made of a conventional toner cartridge for the toner replenishing unit 230. Since the configuration of a toner cartridge does not depend on the developing means 10, the ease of toner replenishment is enhanced. This, coupled with the fact that the toner cartridge scheme easily sets up standardization among different types of machines, further enhances productivity and offers a considerable economic effect, thereby saving cost. In addition, the toner replenishing unit 230 may also be constructed independently of the developer normalizing means 1000 and located at a desired position, which case only the toner will be transferred to the normalizing means 1000. Such a configuration is also effective to promote the free layout of the developing device.

Figure 7:
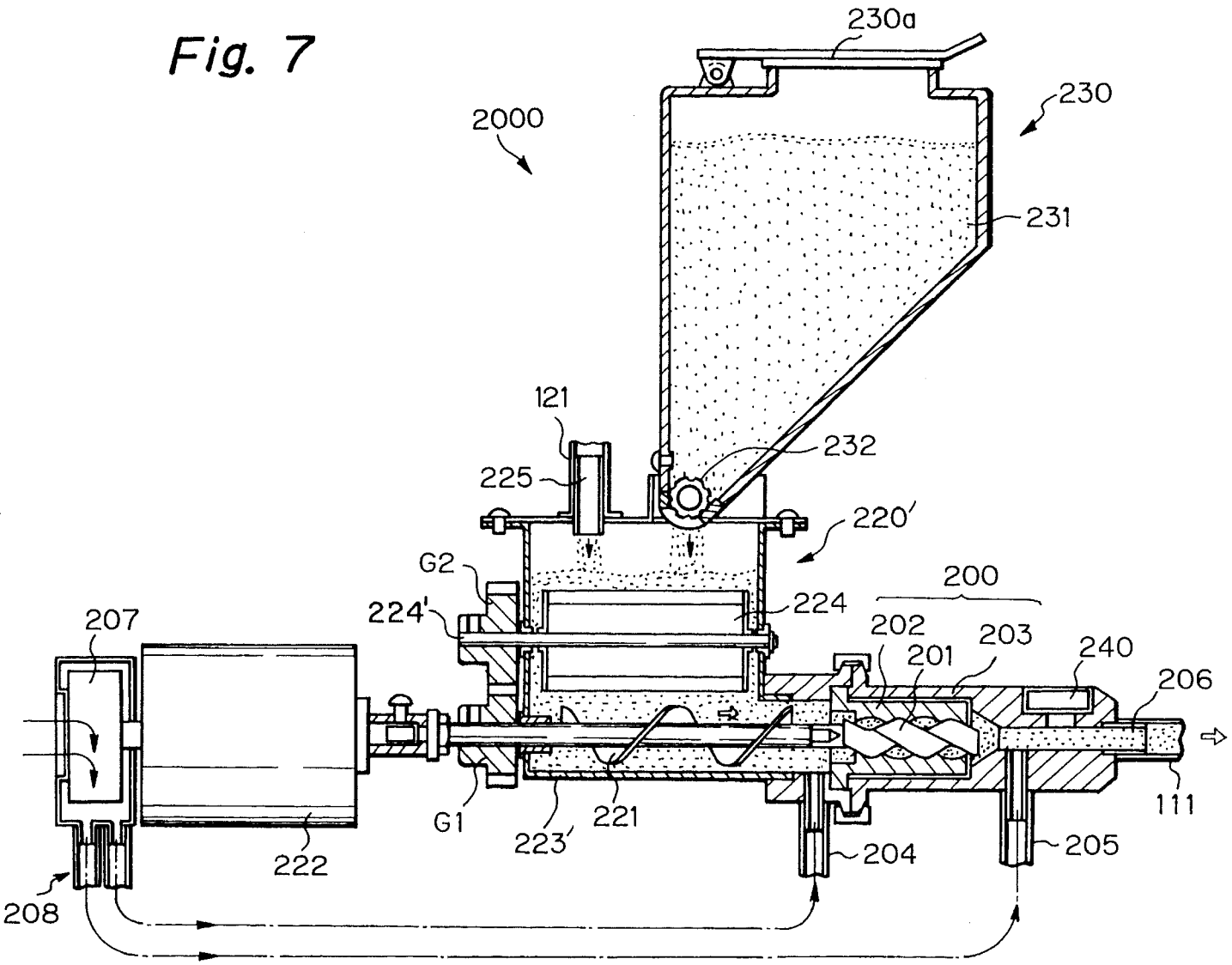
FIG. 7 is a section showing another specific configuration of the developer normalizing means.

Referring to FIG. 7, another specific construction of the developer normalizing means will be described. As shown, developer normalizing means 2000 has a horizontal or flat configuration in contrast to the upright configuration of the normalizing means 1000. The function of the normalizing means 2000 is basically the same as the function of the normalizing means 1000 shown in FIG. 6. Hence, the same or similar constituent parts of the normalizing means 2000 as or to the parts of the normalizing means 1000 are designated by the same reference numerals, and a detailed description thereof will not be made in order to avoid redundancy. The major difference is that the normalizing means 2000 has an agitating member 224 disposed above and constructed integrally with the agitating screw 221. The screw 221 is supported by a receptacle 223'. The agitating member 224 agitates the developer conveyed to the receptacle 223' by the developer transferring and circulating means 300.

A gear G1 is mounted on one end of the screw 221 which is driven by the drive motor 222. The agitating member 224 is mounted on a shaft 225 which is journalled to the receptacle 223' via bearings. A gear G2 is mounted on the shaft 224' and held in mesh with the gear G1. When the screw 221 is rotated by the drive motor 222, the agitating member 224 is also rotated in synchronism with the screw 221. The toner replenishing unit 230 and the collection passage 121 from the developing means 10 are communicated to the receptacle 223'. When the toner supply member 232 of the replenishing unit 230 is rotated, fresh toner 231 is replenished from the unit 230 into the receptacle 223'. The replenishing unit 230, agitating member 224 disposed in the receptacle 223' constitute developer storing means in combination with an agitating unit 220' having the screw 221.

The flat developer normalizing means 2000 agitates the developer and fresh toner 231, as follows. First, the agitating member 224 agitates the developer existing in the receptacle 223', and then the agitating screw 221 located at the bottom of the receptacle 223' feeds it to the pump unit 200. In this manner, the direction in which the developer is fed by the screw 221 and pump unit 200 is different from the direction which the fresh toner 231 and collected developer fall. This is why the normalizing means 2000 is provided with the agitating member 224. The agitating member 224 promotes the agitation of the developer and the deposition of an adequate amount of charge. The normalized developer is fed to the developing means 10 by the agitating screw 221 and pump unit 200.

In summary, it will be seen that the present invention provides a developing unit which is easy to maintain since developing means thereof, facing an image carrier, is small in size and simple in configuration.

Various modifications will become possible for those skilled in the art after receiving the teachings of the present disclosure without departing from the scope thereof.

What is claimed is:

1. A developing device for developing a latent image electrostatically formed on an image carrier, the device comprising:

developing means for depositing a developer consisting of toner and carrier on the image carrier;

developer normalizing means for normalizing the developer and located at a different position from said developing means; and developer transferring and circulating means for transferring the developer to said developing means and said developer normalizing means;

wherein said developer transferring and circulating means comprises a screw pump; and said screw pump comprises:

a pump unit comprising a rotor and a stator contacting said rotor; and an air supply arrangement for supplying air to said pump unit.

2. A device as claimed in claim 1, wherein said developer normalizing means comprises developer density normalizing means for normalizing a mixture ratio of the toner and the carrier.

3. A device as claimed in claim 1, wherein said developer normalizing means comprises agitating means for normalizing an amount of charge to deposit on the toner and the carrier.

4. A device as claimed in claim 1, wherein said developer normalizing means comprises impurity removing means for removing impurities from the developer.

5. A device as claimed in claim 1, further comprising a density sensor for sensing a density of the developer and interposed between said developer normalizing means and said developing means and downstream of said developer normalizing means.

6. A device as claimed in claim 5, wherein said density sensor is mounted on a holder to which said developer transferring and circulating means is affixed.

7. A developing device for developing a latent image electrostatically formed on an image carrier, the device comprising:

developing means for depositing a developer consisting of toner and carrier on the image carrier;

developer storing means for storing the developer and located at a different position from said developing means; and developer transferring and circulating means for transferring the developer to said developing means and said developer storing means;

wherein said developer storing means comprises:

a developer agitating member provided integrally with a developer storing member which stores the developer; and a toner supply member for supplying toner to said developer storing member.

8. A developing device for developing a latent image electrostatically formed on an image carrier, the device comprising:

developing means for depositing a developer consisting of toner and carrier on the image carrier;

developer normalizing means for normalizing the developer and located at a different position from said developing means;

developer transferring and circulating means for transferring the developer to said developing means and said developer normalizing means; and a density sensor for sensing a density of the developer and interposed between said developer normalizing means and said developing means and downstream of said developer normalizing means.

9. A device as claimed in claim 8, wherein said density sensor is mounted on a holder to which said developer transferring and circulating means is affixed.

10. A developing device for developing a latent image electrostatically formed on an image carrier, the device comprising:

developing means for depositing a developer including toner and carrier on an image carrier;

developer normalizing means for normalizing the developer and located at a different position from said developing means, said developer normalizing means comprising an agitating unit having a first opening for receiving toner from said developing means through a collection tube and a second opening for receiving fresh toner from a replenishing unit; and a developer transferring and circulating means comprising a pump unit located at an outlet of said agitating unit, said pump unit delivering toner from said agitating unit to a supply tube which leads to the developing means.

11. A device as claimed in claim 10, wherein said agitating unit comprises a screw member.

12. A device as claimed in claim 10, wherein said pump unit comprises a rotor and stator assembly.

* * * * *